United States Patent [19]

Johnson

[11] 4,327,503

[45] May 4, 1982

[54] OUTER SOLE STRUCTURE FOR ATHLETIC SHOE

[75] Inventor: Jeffrey O. Johnson, Newton, N.H.

[73] Assignee: BRS, Inc., Beaverton, Oreg.

[21] Appl. No.: 112,842

[22] Filed: Jan. 17, 1980

[51] Int. Cl.[3] ..... A43B 13/04; A43B 13/26; A43C 15/00

[52] U.S. Cl. ..... 36/32 R; 36/59 C; 36/67 A; 36/129; D2/320

[58] Field of Search ..... 36/32 R, 59 R, 59 C, 36/114, 128, 129, 67 A; D2/319, 320, 321

[56] References Cited

U.S. PATENT DOCUMENTS

| | | | |
|---|---|---|---|
| D. 171,130 | 12/1953 | Gruner | D2/320 |
| 989,514 | 4/1911 | Sanford . | |
| 2,038,972 | 4/1936 | Watanabe | 36/32 R |
| 2,722,756 | 11/1955 | Ecclesine . | |
| 3,494,055 | 2/1970 | McSorley . | |
| 3,623,244 | 11/1971 | Williams . | |
| 3,808,713 | 5/1974 | Dassler . | |
| 3,818,617 | 6/1974 | Dassler et al. . | |
| 3,988,840 | 11/1976 | Minihane . | |
| 4,067,123 | 1/1978 | Minihane . | |
| 4,083,125 | 4/1978 | Benseler et al. . | |
| 4,085,527 | 4/1978 | Riggs . | |
| 4,233,759 | 11/1980 | Bente et al. | 36/32 R |

FOREIGN PATENT DOCUMENTS

| | | | |
|---|---|---|---|
| 249549 | 9/1966 | Austria | 36/59 C |
| 1906397 | 10/1970 | Fed. Rep. of Germany | 36/129 |
| 2618655 | 11/1977 | Fed. Rep. of Germany | 36/59 R |
| 2717910 | 10/1978 | Fed. Rep. of Germany | 36/59 R |
| 52-26941 | 2/1977 | Japan | 36/59 R |

*Primary Examiner*—James Kee Chi

*Attorney, Agent, or Firm*—Schuyler, Banner, Birch, McKie & Beckett

[57] ABSTRACT

A general purpose athletic shoe is described in which an outer sole is provided with integrally molded cleats of two different types. The cleats of the first type are disposed around the periphery of the sole and the cleats of the second type are primarily disposed in the remaining portions of the sole. The second cleats are generally conical in shape and extend outwardly from the sole to about half the height of the first cleats. Each of the first cleats has three surfaces extending outward from a major exterior surface of the outer sole to a flat crown which is parallel to the major exterior surface. Two of the three outwardly extending surfaces of each of the first cleats take the form of essentially flat surfaces oriented generally perpendicular to the major exterior surface and the remaining outwardly extending surface is a partial conical surface which tapers so that first cleats are widest at their junction with the outer sole and narrowest at the crown. One of the essentially flat surfaces of each of the first cleats is generally transversely oriented with respect to the sole and the other essentially flat surface is aligned with the contour of the adjacent edge of the sole.

19 Claims, 5 Drawing Figures

FIG. 1
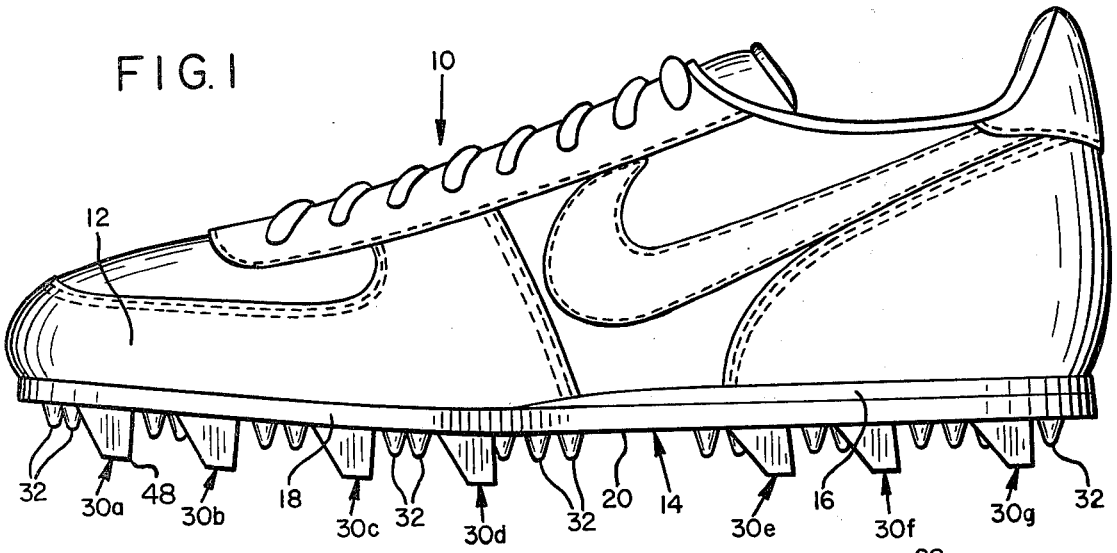
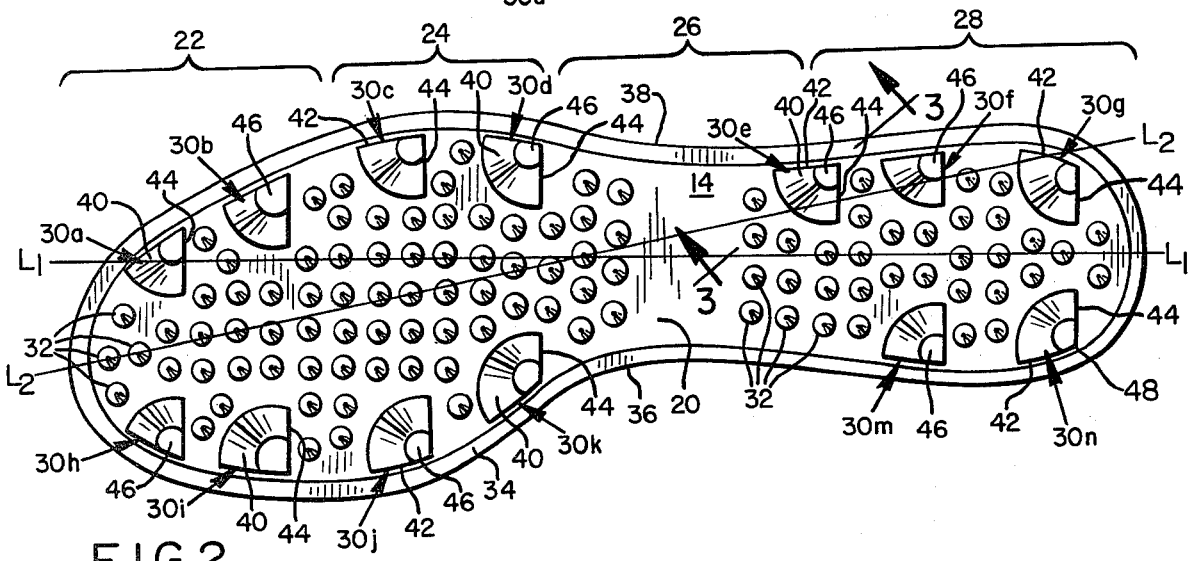
FIG. 2
FIG. 3
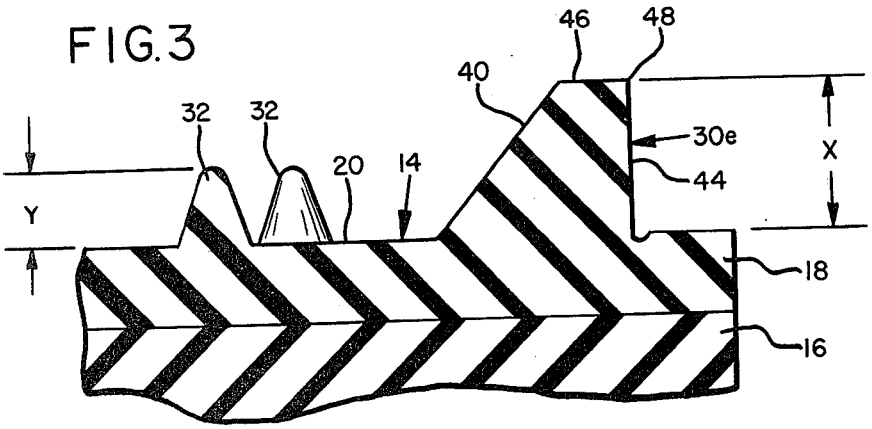

OUTER SOLE STRUCTURE FOR ATHLETIC SHOE

BACKGROUND OF THE INVENTION

The present invention pertains generally to cleated athletic shoes and more particularly to an improved arrangement and structure of cleats integrally molded with the outer sole of the shoe.

The prior art includes numerous examples of cleating arrangements on the sole of athletic shoes. In most cases, the cleats on a particular sole are of a uniform shape, whereas, in some cases, cleats of more than one type are provided. U.S. Pat. No. 3,988,840, of Robert P. Minihane, issued Nov. 2, 1976, is an example of a sole structure having cleats of two different types including uniformly spaced frustoconical cleats in the ball and heel areas and spaced peripheral cleats at the edges of the sole. In accordance with an important aspect of the Minihane patent, the peripheral cleats are shorter than the frustoconical cleats. The sole described by the Minihane patent was specifically designed for use on artificial turf and it was noted that the design of a sole for use on a natural surface is not necessarily the best design for use on a synthetic surface.

It would be desirable to provide a cleated sole structure which performs well on both synthetic and natural surfaces and yet is light in weight, durable, and inexpensive to fabricate.

SUMMARY OF THE INVENTION

In accordance with the present invention, an athletic shoe is provided with a sole structure and two types of integrally molded cleats. A plurality of first cleats are peripherally disposed along curved edges of the sole and a plurality of second cleats are disposed intermediate the first cleats in a generally uniform pattern primarily in the toe, ball and heel portions. The first cleats are greater in height than the second cleats. Each of the first cleats has at least one essentially flat surface and one tapering surface extending outwardly from a major exterior surface of the sole to an essentially flat crown which forms the weight-bearing surface of each of the first cleats. The flat outwardly extending surface of each of the first cleats forms a peripheral face of each such cleat and conforms to the curved contour of the adjacent edge of the sole. The tapering surface forms, at least in part, a forward facing surface of each first cleat. Each first cleat preferably also includes another essentially flat surface which is perpendicular to the major exterior surface and forms the rearward face of each such cleat.

One advantage of the inventive sole structure is the excellent longitudinal stability provided as the heel, ball and toe of the sole strike the turf, particularly during rapid longitudinal acceleration and deceleration movements, due primarily to the effect of the forward facing portions of the tapering surfaces diffusing some of the shock of initial contact of the respective portions of the sole with the turf, before the gripping action of the pointed second cleat takes effect.

Another advantage is the excellent lateral traction provided during quick lateral movements (changing directions) due primarily to the effect of the essentially flat peripheral face of each of the first cleats engaging relatively large surface areas of turf at the edges of the sole.

Yet another advantage is the excellent forward acceleration derived from the flat rearward faces of each of the first cleats in the toe and ball portions of the sole engaging relatively large surface areas of turf with each step taken during the forward propulsion phase of running.

A further advantage of the invention is the tendency of the preferred sole structure hereinafter described to reduce common leg injuries by virtue of the slightly delayed gripping action which occurs upon planting the foot.

The presently preferred way of carrying out the invention and various inherent advantages thereof will become apparent from the following description of two illustrative embodiments thereof when read in conjunction with the accompanying drawing.

BRIEF DESCRIPTION OF THE DRAWING

FIG. 1 is a side elevation view of an athletic shoe having a cleated sole structure in accordance with a first embodiment of the present invention looking at the outside edge of the sole.

FIG. 2 is a bottom plan view of the shoe of FIG. 1 showing a first preferred arrangement of cleats on the sole.

FIG. 3 is an enlarged fragmentary cross-section taken along line 3—3 of FIG. 2.

Figure 4:
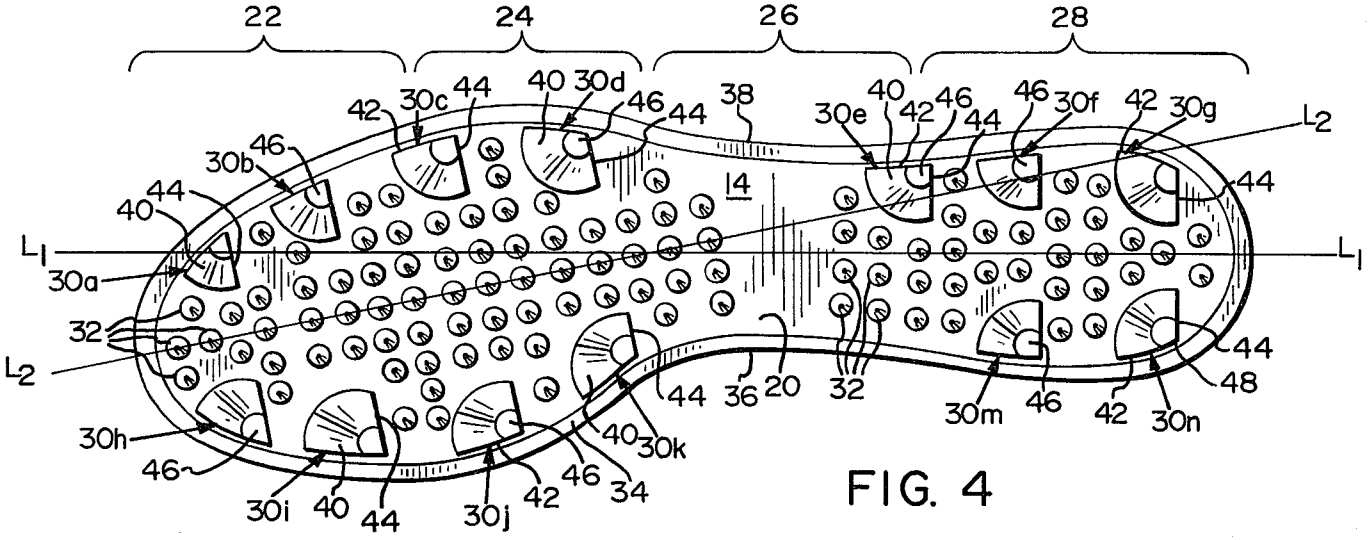
FIG. 4 is a bottom plan view similar to FIG. 2 showing a cleated sole structure in accordance with a second embodiment of the present invention wherein a second preferred arrangement of cleats is employed.

The various parts in each of the figures are drawn essentially to scale.

DESCRIPTION OF THE PREFERRED EMBODIMENTS

Referring to FIG. 1, an athletic shoe in accordance with the present invention is illustrated and designated generally by reference numeral 10. The shoe 10 includes an essentially conventional shoe upper 12 which is joined to a multilayered sole assembly including a cleated outer sole 14 and a heel lift sole layer 16. It will be appreciated that the sole construction also includes a cushioning inner sole which has not been specifically illustrated inasmuch as its features bear no particular relationship to the present invention. It will also be appreciated that the sole layers 14 and 16 can be integrally formed as a single unit rather than being provided separately as in the present example. The cleated outer sole 14 comprises a relatively hard rubber or other moldable, resilient, polymeric material which is highly resistant to wear and abusive treatment. The sole 14 includes a base 18 having a major exterior surface 20, outwardly from which a plurality of cleats of two different types extend.

Referring now to FIG. 2, a first preferred structure and arrangement of cleats will be described. The sole 14 can be considered to consist of four functionally distinct areas defined along the length of the shoe 10. The functionally distinct areas consist of a toe area 22, a ball area 24, an arch area 26, and a heel area 28. The cleats include relatively large cleats disposed along the periphery of the base 18 and smaller conical cleats disposed in a generally uniformly spaced array in the portions of the base 18 not occupied by the large peripheral cleats, except for an optional cleatless region in the arch 26.

Since cleats in the arch area 26 are only of minimal benefit, this area is ideal for placement of a trademark logo or the like. The cleatless region serves this purpose.

The relatively large peripheral cleats are designated by reference numeral 30 with appended letters being used to distinguish among cleats at different positions. The smaller conical cleats, of which only some are designated by reference numeral 32 for clarity of illustration, are uniform in size. The base 18 of the sole has a curved border portion 34 around the entire periphery including arcuate inside and outside edges 36 and 38. The peripheral cleats 30 preferably are disposed in groups of four in each of the toe 22, ball 24 and heel 28 portions of the sole 14 in order to provide four-point stability in each such portion. For example, two cleats 30*a* and 30*b* are disposed along the outside edge 38 within the toe portion 22 and two cleats 30*h* and 30*i* are disposed along the inside edge 36 within the toe portion 22, corresponding cleats preferably being positioned in a spaced balanced manner on opposite sides of the sole 14 as shown. In order to increase the lateral stability of the sole 10 while making quick turn, an additional large cleat 30*e* is optionally provided along the outside edge 38 at the interface of the arch and heel portions 26 and 28.

With particular reference to FIG. 3, various preferred detailed features of the cleats will now be described. It will be appreciated from this sectional view that the various cleats 30 and 32 are integrally molded with the base 18, providing excellent integrity and durability. The larger cleats 30 extend outwardly to about twice the height of the smaller cleats 32. The height "X" of each of the larger cleats 30 is preferably about 7/16 inch and the height "Y" of the smaller cleats 32 is preferably about 7/32 inch. The smaller cleats 32 are generally conical in shape with a slightly rounded outer tip. The larger cleats 30 assume the general shape of a section of a frustum, as will be appreciated best from the view of FIG. 2. Each cleat 30 has a conical surface, only some of which are designated by reference numeral 40 for sake of clarity. Each cleat 30 also has three essentially flat surfaces consisting of a peripheral vertical surface 42, a rearward vertical surface 44, and a horizontal surface or crown 46. The essentially flat surfaces 42, 44 and 46 intersect at a point which defines a gripping corner 48 at the periphery of the sole 14. "Essentially flat" as used herein is intended to include a slightly curved surface, such as the surfaces 42 on the rearmost cleats 30*g* and 30*n*. As seen in FIG. 2, each peripheral surface 42 conforms to the curved contour of the adjacent edge of the base 18. All of the essentially flat vertical surfaces 42 and 44 preferably lie in planes which are perpendicular to the major exterior surface 20 of the base 18. All of the rearward vertical surfaces 44 of this embodiment lie in parallel planes which are generally transversely oriented with respect to the sole 14. Since the various peripheral vertical surfaces 42 are aligned with the proximate portion of the respective adjacent edge 36 or 38, the flat vertical surfaces 42 and 44 on each cleat 30 will define various different angles, as is apparent from the view of FIG. 2. In particular, all of the cleats 30 in the toe portion 22, cleat 30*c* in the ball portion 24, the odd cleat 30*e*, and cleats 30*f* and 30*m* in the heel portion 28 exhibit various acute angles. Cleats 30*d*, 30*j* and 30*k* in the ball portion 24 and cleats 30*g* and 30*n* in the heel portion 28 have surfaces 42 and 44 which intersect to form various obtuse angles.

Referring now to FIG. 4, a second preferred structure and arrangement of cleats will be described. The same reference numberals employed with the previously described embodiment of FIGS. 1–3 are repeated on similar parts in the embodiment of FIG. 4. The two embodiments differ in the manner in which the cleats are positioned in the toe and ball areas 22 and 24. Those skilled in the art will appreciate that it is typical for shoes other than straight lasted shoes to have two longitudinal axes. As depicted in FIG. 4, the shoe has a rearfoot longitudinal axis $L_1$ bisecting the heel area 28 and a forefoot longitudinal axis $L_2$ bisecting the toe and the ball areas 22 and 24.

It will be readily apparent that the large peripheral cleats 30 in the toe and ball areas 22 and 24 of the sole of FIG. 4 are provided in transversely balanced pairs straddling the forefoot longitudinal axis $L_2$. For example, cleat 30*a* is aligned with respect to cleat 30*h* so that the rearward vertical surfaces 44 of each lie in a single plane that is perpendicular to the $L_2$ axis. The same relationship with respect to the $L_2$ axis exists for the other pairs of cleats (30*b* and 30*i*; 30*c* and 30*j*; 30*d* and 30*k*) in the toe and ball areas 22 and 24 of the sole of FIG. 4. A similar relationship with respect to the rearfoot longitudinal axis $L_1$ exists for the pairs of cleats (30*f* and 30m; 30*g* and 30*n*) in the heel area 28.

Referring again to FIG. 2, it will be seen that all of cleats 30 are positioned with their flat rearward surfaces 44 in planes that are perpendicular to the rearfoot longitudinal axis $L_1$. It is believed that the particular running style of the athlete will determine which of the two preferred sole embodiments herein described will be most preferable. Athletes who employ long straight running strides might favor the embodiment of FIG. 2 whereas athletes who employ short quick running strides with their toes pointing slightly outward might favor the embodiment of FIG. 4. It will of course be appreciated that the particular sporting event will have a bearing on the style employed by the athlete and thus also on his preference between the two sole embodiments. It is anticipated that soccer players will prefer the embodiment of FIG. 2 and that football players will prefer the embodiment of FIG. 4.

From the foregoing description of the two preferred embodiments herein described, it will be apparent that the sole structure of the present invention affords many advantages. The athletic shoe 10 with either preferred sole will perform particularly well in activities requiring the user to make abrupt turns in various directions. Accordingly, the invention is particularly useful in football, soccer and similar sporting activities. Excellent lateral traction is provided while making abrupt turns primarily by the flat peripheral surfaces 42 at the edges of the sole 14 engaging relatively large surface areas of turf. The gripping corners 48 are useful for digging deep into natural turf, particularly when wet. Excellent forward propulsion is provided by the flat rearward surfaces 44, particularly those on the cleats 30 in the toe and ball portions 22 and 24 of the sole 14, which dig in and work against relatively large areas of turf. Excellent control during deceleration (while stopping) and during abrupt turns is provided by the tapered or conical surfaces 40, which soften the shock of impact with the turf. The conical surfaces 40, particularly the forward facing portions thereof, allow the sole 14 to glide slightly at initial impact with the turf until the penetration is sufficient for the conical cleats 32 to obtain good gripping action in the turf. In effect, a slightly delayed gripping action is achieved, thus reducing the shock on the foot, ankle and lower leg of the athlete. It is believed that the foregoing features of the sole 14 not only provide many improvements in performance but also tend to reduce the commonly occurring leg injuries.

In accordance with an important feature of the present invention, the preferred sole structures described above perform extremely well both on synthetic and natural surfaces. It should be apparent to those skilled in the art that the relatively large, sharp-cornered, peripheral cleats 30 will readily penetrate natural turf to provide excellent traction. With regard to synthetic turf, however, a unique cooperation between the large peripheral cleats 30 and the small conical cleats 32 takes effect. It will be appreciated that a resilient, compressible cushion or pad underlies the top layer of synthetic turf. The large cleats 30 deform this underlying pad around the periphery of the sole when the foot is planted causing the grass-like synthetic surface to be driven up within the interior spaces of the sole where contact is made with the small conical cleats 32. In effect, the top layer of synthetic turf becomes mechanically locked within the peripheral cleats 30 and the resiliency of the underlying pad forces the top layer of synthetic turf into frictional engagement with the small conical cleats 32. The relatively large surface area provided by the many small conical cleats 32 greatly increases the coefficient of friction between the sole and the synthetic turf, thereby greatly increasing traction.

Figure 5:
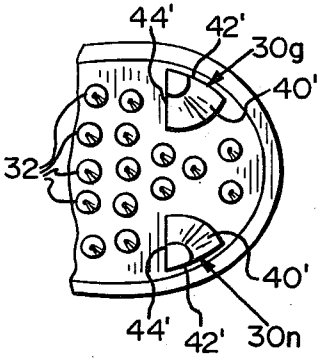
FIG. 5 is a fragmentary bottom plan view showing a modified arrangement of rearmost peripheral cleats.

Referring to FIG. 5, a modification which can be applied to either of the two previously described sole embodiments will now be described. The rearmost cleats **30*g* and 30*n* are each arranged so that a flat vertical surface 44' forms the forward (instead of the rearward) face of the cleat. The conical surfaces 40' face rearward and inward. Other features of the cleats 30*g* and 30*n* are similar to their previously described counterparts. The flat forward facing surfaces 44' are intended to achieve faster stopping action as the heel is planted. It is believed that this feature might be preferred by some football players who desire to make quick stopping or turning movements. It will be appreciated that the surfaces 44'** will dig in and engage relatively large surface areas of turf as the heel is planted thereby assisting in making a quick stop.

Although two preferred embodiments of the invention and a modification thereof have been described in detail, it will be appreciated that various other alternative embodiments and modifications thereof are within the spirit and scope of the invention as defined by the appended claims.

What is claimed is:

1. A sole for an athletic shoe, comprising a molded polymeric base and a plurality of integrally molded cleats extending outwardly from the base, including peripheral cleats each having the general shape of a section of a frustum, a majority of said peripheral cleats having a generally forwardly facing surface in the shape of a sectional surface of a cone, a generally rearwardly facing essentially flat surface, an essentially flat peripheral surface facing the periphery at which the respective first cleat is disposed and an essentially flat crown surface spaced from the base and joining with said forwardly facing surface, said rearwardly facing surface and said peripheral surface, and an interior array of conical cleats of a lesser height than that of the peripheral cleats, said conical cleats being of greater number than said peripheral cleats and having a cross-sectional area in a plane adjacent the base less than the cross-sectional area of said peripheral cleats in a plane adjacent the base whereby a delayed gripping action of said conical cleats is caused by said peripheral cleats.

2. The sole of claim 1 wherein said peripheral cleats have a height at least approximately twice that of said conical cleats.

3. A sole for an athletic shoe, comprising an outer sole member of a resilient polymeric material having a base and a plurality of integrally molded first and second cleats extending outwardly from the base, the first cleats being peripherally disposed at the edges of the sole, the second cleats being generally uniformly disposed in the interior areas of the sole and being of greater number than said first cleats, the first cleats having a height approximately twice that of the second cleats, each of the first cleats assuming the general shape of a section of a frustum having a conical surface and first, second and third essentially flat surfaces, the first flat surface being disposed generally perpendicular to the base and aligned with the adjacent edge of the sole, the second flat surface being generally parallel to the sole and defining the outermost surface of the cleat, the third essentially flat surface being substantially perpendicular both to the base and to a longitudinal axis of the sole, the conical surface having a principal conical axis generally perpendicular to the sole, the conical surface having its largest radial dimension at its junction with the base and its smallest radial dimension at its junction with the second flat surface.

4. The sole of claim 3 wherein the second cleats are shaped as outwardly pointed cones.

5. The sole of claim 3 wherein the first cleats include two rearmost cleats each of whose third essentially flat surface faces forward and the third essentially flat surfaces of the remaining first cleats face rearward.

6. A sole for an athletic shoe, comprising an outer sole member of a resilient polymeric material having a base and plurality of integrally molded first and second cleats extending outwardly from the base, the sole member including a toe portion, a ball portion, an arch portion and a heel portion correspondingly positioned with respect to the toe, ball, arch and heel of the human foot, the base having arcuate inside and outside edges correspondingly positioned with respect to the inside and outside edges of the human foot, the first cleats being peripherally disposed along the inside and outside edges of the base primarily in the toe, ball and heel portions, the second cleats being disposed in a generally uniformly spaced arrangement throughout at least the areas of the toe, ball and heel portions not occupied by the first cleats, the first cleats being greater in height than the second cleats, each of the first cleats having an essentially flat crown lying generally parallel to the base and further having first and second essentially flat surfaces, said first flat surface lying adjacent to the proximate edge of the base, the first flat surface being generally perpendicular to the base and aligned with the proximate edge of the base, the second flat surface lying in a plane substantially perpendicular to a longitudinal axis of the sole, a majority of said first cleats also having a tapered surface with its largest dimension at the base and extending to the crown, the tapered surface providing at least in part a forward facing portion of the respective cleat said flat crown extending between and joining with said tapered surface and said first and second flat surfaces whereby the intersection of said flat crown and said first and second flat surfaces provides a gripping corner at the periphery of the sole.

7. The sole of claim 6 wherein each of the first cleats has said tapered surface.

8. The sole of claim 6 wherein the plurality of first cleats includes four cleats in each of the toe, ball and heel portions positioned in balanced parts on opposite sides of a longitudinal axis of the sole, whereby four-point stability is provided in each of the toe, ball and heel portions of the sole.

9. The sole of claim 6 wherein the inside and outside edges follow a curved contour corresponding generally to the curved outline of the human foot such that the respective first and second flat surfaces on some of the first cleats form acute angles at their intersection and the respective first and second flat surfaces on other of the first cleats form obtuse angles at their intersection.

10. The sole of claim 6 wherein a first longitudinal axis bisects the heel portion and a second longitudinal axis bisects the toe and ball portions, the axes being nonparallel, the first cleats in the heel portion being provided in transversely balanced pairs straddling the first longitudinal axis and the first cleats in the toe and ball portions being provided in transversely balanced pairs straddling the second longitudinal axis.

11. The sole of claim 10 wherein the second essentially flat surfaces of cleats in the heel portion lie in planes which are substantially perpendicular to the first longitudinal axis and the second essentially flat surfaces of cleats in the toe and ball portions lie in planes which are substantially perpendicular to the second longitudinal axis.

12. A sole for an athletic shoe, comprising an outer sole member of a resilient polymeric material having a base and a plurality of first and second cleats extending from the base, said first cleats being disposed along the periphery of said sole, said second cleats being disposed in the interior areas of said sole, said first cleats being greater in height than said second cleats, each of said first cleats assuming the general shape of a section of a frustum having a generally conical surface and first, second and third essentially flat surfaces, the conical surface in a majority of said first cleats facing generally forward, the first flat surface in a majority of said first cleats facing generally rearward, the second flat surface in a majority of said first cleats being spaced from said base and the third flat surface of said first cleats facing the adjacent peripheral edge, the second flat surface extending between and joining with said conical surface and said first and third flat surfaces to form a gripping corner.

13. The sole of claim 12 wherein said sole member includes a toe portion, a ball portion, an arch portion and a heel portion, each of the conical surfaces of said first cleats in said toe and ball portion facing generally forward.

14. The sole of claim 13 wherein each of the conical surfaces of said first cleats in said heel portion face generally forward.

15. The sole of claim 13 wherein the conical surfaces of a rearmost pair of said first cleats in said heel portion face generally rearward.

16. A sole for an athletic shoe, comprising an outer sole member of a resilient polymeric material having a base and a plurality of first and second cleats extending from the base, said sole member having a toe area, a ball area, an arch area and a heel area, said first cleats being disposed along the periphery of said sole in at least said toe, ball and heel areas, said second cleats being disposed in the interior areas of said sole, said first cleats having a height approximately at least twice the height of said second cleats, each of said first cleats assuming the general shape of a section of a frustum having a generally conical surface and first, second and third essentially flat surfaces, the conical surface of said first cleats in at least said toe and ball areas facing generally forward, the first flat surface of said cleats in at least said toe and ball areas facing generally rearward, the second flat surface in each of said first cleats being generally parallel to said base, the third flat surface in each of said first cleats facing the periphery along which it is disposed, said second flat surface joining with and extending between said conical surface and said first and third flat surfaces, and said first and third flat surfaces extending from said second flat surface to said base.

17. The sole of claim 16 wherein each first and third flat surface of said first cleats extends generally perpendicularly from said base.

18. The sole of claim 16 or 17 wherein the first flat surface of the rearmost pair of cleats in the heel area faces generally forward.

19. The sole of claim 16 or 17 wherein each first flat surface of said first cleats faces generally rearward.

* * * * *

UNITED STATES PATENT AND TRADEMARK OFFICE

CERTIFICATE OF CORRECTION

PATENT NO. : 4,327,503
DATED : May 4, 1982
INVENTOR(S) : Jeffrey O. Johnson

It is certified that error appears in the above—identified patent and that said Letters Patent is hereby corrected as shown below:

Column 3, line 23, the word "turn" should be changed to —turns—; and

Claim 8, column 7, line 7, the word "parts" should be —pairs—.

Signed and Sealed this

*Thirteenth* Day of *July 1982*

[SEAL]

*Attest:*

GERALD J. MOSSINGHOFF

*Attesting Officer*

*Commissioner of Patents and Trademarks*